US010363590B2

(12) United States Patent
Bergman et al.

(10) Patent No.: US 10,363,590 B2
(45) Date of Patent: Jul. 30, 2019

(54) SHAPE CORRECTION LEVELER DRIVE SYSTEMS

(71) Applicant: Machine Concepts, Inc., Minster, OH (US)

(72) Inventors: Guil Bergman, Ft. Recovery, OH (US); Matt Bonnoront, Anna, OH (US); Anthony Enneking, Minster, OH (US); Chris Heid, Minster, OH (US)

( * ) Notice: Subject to any disclaimer, the term of this patent is extended or adjusted under 35 U.S.C. 154(b) by 601 days.

(21) Appl. No.: 15/076,503

(22) Filed: Mar. 21, 2016

(65) Prior Publication Data

US 2016/0271669 A1 Sep. 22, 2016

Related U.S. Application Data

(60) Provisional application No. 62/135,436, filed on Mar. 19, 2015.

(51) Int. Cl.
*B21D 1/02* (2006.01)

(52) U.S. Cl.
CPC ..... *B21D 1/02* (2013.01)

(58) Field of Classification Search
CPC ..... B21D 1/02; B21D 3/02; B21D 1/06
See application file for complete search history.

(56) References Cited

U.S. PATENT DOCUMENTS

| | | | |
|---|---|---|---|
| 2,315,446 | A | 3/1943 | Miller et al. |
| 2,335,334 | A | 11/1943 | Yoder |
| 2,476,254 | A | 7/1949 | Winlock |
| 2,742,949 | A | 4/1956 | Nilsson |
| 3,006,224 | A | 10/1961 | Celovsky |
| 3,049,036 | A | 8/1962 | Wallace et al. |
| 3,280,921 | A | 10/1966 | Bickford |
| 3,298,212 | A | 1/1967 | Cook |
| 3,301,031 | A | 1/1967 | Bearer |
| 3,314,264 | A | 4/1967 | Vater et al. |
| 3,416,340 | A | 12/1968 | Reesor |
| 3,457,747 | A | 7/1969 | Yeomans |
| 3,559,431 | A | 2/1971 | Noe et al. |
| 3,581,536 | A | 6/1971 | Terwilliger |
| 3,596,489 | A | 8/1971 | Ball |
| 3,683,653 | A | 8/1972 | Cox |
| 3,735,217 | A | 5/1973 | Kilgore et al. |
| 3,765,212 | A | 10/1973 | Moslener |

(Continued)

FOREIGN PATENT DOCUMENTS

| | | | |
|---|---|---|---|
| EP | 1491270 | A1 | 12/2004 |
| GB | 751615 | A | 7/1956 |

(Continued)

OTHER PUBLICATIONS

ABB Oy, Master/Follower Application Guide Supplement to Firmware Manual for ACS800 Standard Application Program, Dec. 2, 2002.

(Continued)

*Primary Examiner* — Teresa M Ekiert
(74) *Attorney, Agent, or Firm* — Standley Law Group LLP; Eric M. Gayan; Adam J. Smith

(57) ABSTRACT

Drive systems for multi-roll shape-correction levelers used to flatten metal strip material, wherein the drive systems are adapted to account for the effects of differential roll speed such that the work rolls of entry side roll clusters and the work rolls of exit side roll clusters of the leveler can be made to equally share the load associated with a leveling operation.

20 Claims, 10 Drawing Sheets

(56) References Cited

U.S. PATENT DOCUMENTS

| | | | |
|---|---|---|---|
| 3,766,767 | A | 10/1973 | Rastelli |
| 3,798,951 | A | 3/1974 | Fornataro |
| 3,867,826 | A | 2/1975 | Noe |
| 3,875,776 | A | 4/1975 | Morooka |
| 3,887,314 | A | 6/1975 | Andresen et al. |
| 3,902,345 | A | 9/1975 | Shida |
| 3,940,960 | A | 3/1976 | Tanifuji et al. |
| 3,962,894 | A | 6/1976 | Noe et al. |
| 4,061,947 | A | 12/1977 | Vogel |
| 4,083,217 | A | 4/1978 | Johnson |
| 4,116,029 | A | 9/1978 | Fabian et al. |
| 4,137,742 | A | 2/1979 | Tanifuji et al. |
| 4,222,256 | A | 9/1980 | Johnson |
| 4,373,147 | A | 2/1983 | Carlson, Jr. |
| 4,408,470 | A | 10/1983 | Fromont et al. |
| 4,454,738 | A | 6/1984 | Buta |
| 4,559,482 | A | 12/1985 | Fencl |
| 4,566,299 | A | 1/1986 | Koyama et al. |
| 4,586,356 | A | 5/1986 | Frou et al. |
| 4,593,549 | A | 6/1986 | Moriya et al. |
| 4,635,458 | A | 1/1987 | Bradlee |
| 4,651,549 | A | 3/1987 | Masui |
| 4,698,990 | A | 10/1987 | Petri et al. |
| 4,715,209 | A | 12/1987 | Oshima |
| 4,726,213 | A | 2/1988 | Manchu |
| 4,730,472 | A | 3/1988 | Ellis |
| 4,881,392 | A | 11/1989 | Thompson et al. |
| 4,893,489 | A | 1/1990 | Mason |
| 5,069,054 | A | 12/1991 | Hladky et al. |
| 5,329,798 | A | 7/1994 | Takakura et al. |
| 5,535,129 | A | 7/1996 | Keijser |
| 5,560,237 | A | 10/1996 | Yasuda et al. |
| 5,625,262 | A | 4/1997 | Lapota |
| 5,680,785 | A | 10/1997 | Quehen et al. |
| 5,708,332 | A | 1/1998 | Bottger et al. |
| 5,901,591 | A | 5/1999 | Kaplan |
| 5,940,105 | A | 8/1999 | Hayami |
| 6,029,485 | A | 2/2000 | Bohmer |
| 6,109,084 | A | 8/2000 | Hutzenlaub et al. |
| 6,199,476 | B1 | 3/2001 | Kayser |
| 6,205,829 | B1 | 3/2001 | Schwedt |
| 6,216,517 | B1 | 4/2001 | Hein |
| 6,338,262 | B1 | 1/2002 | Donini et al. |
| 6,879,796 | B2 | 4/2005 | Monahan et al. |
| 6,925,845 | B2 | 8/2005 | Behrens et al. |
| 7,144,238 | B2 | 12/2006 | Chao |
| 7,325,489 | B2 | 2/2008 | Zeigler et al. |
| 7,812,558 | B2 | 10/2010 | Mori et al. |
| 8,893,537 | B2 | 11/2014 | Cox, III |
| 2004/0221633 | A1 | 11/2004 | Abi-Karam |
| 2007/0285045 | A1 | 12/2007 | Franz |
| 2009/0113973 | A1 | 5/2009 | Cox, III |
| 2009/0282883 | A1 | 11/2009 | Noe |
| 2010/0058823 | A1 | 3/2010 | Polatidis et al. |
| 2010/0206033 | A1 | 8/2010 | Ishida et al. |

FOREIGN PATENT DOCUMENTS

| | | | |
|---|---|---|---|
| GB | 1543622 | A | 4/1979 |
| GB | 2024464 | A | 1/1980 |
| JP | 2007144492 | A | 6/2007 |
| SU | 571321 | A1 | 9/1977 |

OTHER PUBLICATIONS

ABB Oy, Master-Follower Communication in ABB Industrial Drives, 2006.

ABB, Product Note, Master-Follower Communication in ABB Industrial Drives, 2012.

The Bradbury Co., Inc, edrive.

Perugini, D., Drive/Motor Load Sharing: Match Technology to Needs, Feb. 1, 1998.

Rockwell International Corporation, Load Sharing Applications for AC Drives, Jun. 2000.

Emerson Industrial Automation, Application Note CTAN #158, Jul. 1, 2005.

Emerson Industrial Automation, Application Note CTAN #190, Jan. 12, 2004.

Mitsubishi Electric Europe B.V., A700 Load Sharing Application Example, Apr. 9, 2006.

Schneider Electric, Load Sharing With the Altivar ATV71 Application Guide.

Siemens AG, Closed-loop Torque Control and Load Distribution, Jul. 2009.

Yaskawa Electric America, Inc., Master-Slave Conveyor Application, Feb. 15, 2006.

KNOWN ART

KNOWN ART

KNOWN ART

KNOWN ART

KNOWN ART

KNOWN ART

KNOWN ART

SHAPE CORRECTION LEVELER DRIVE SYSTEMS

CROSS-REFERENCE TO RELATED APPLICATIONS

This application claims the benefit of U.S. Provisional Application No. 62/135,436, filed on Mar. 19, 2015, which is hereby incorporated by reference as if fully recited herein.

TECHNICAL FIELD

Embodiments of this application are directed to drive systems for multi-roll shape-correction levelers.

BACKGROUND

The basic concept of a multi-roll shape-correction leveler (hereinafter shape-correction leveler or just leveler for brevity) has been known for many years. Shape-correction levelers were developed to account for the deficiencies of known hot rolling mills and the undesirable shape defects hot rolling mills commonly impart to the metal strip produced thereby. Common forms of such shape defects are shown in FIGS. 1A-1D to include coil set, cross bow, edge wave, and center buckle, respectively.

Shape-correction levelers typically use opposing, substantially parallel sets of multiple work rolls that often are supported by back-up rolls and associated bearings designed to withstand high separating forces and to control the bending and deflection of the work rolls. The work rolls are normally positioned so that an upper row of work rolls are located above a cooperating lower row of work rolls. A gap of adjustable dimension is normally present between the upper and lower work rolls.

During a flattening operation, metal strip (typically from a coil) material is fed into the entrance of the leveler whereafter it is caused to pass between the opposing sets of work rolls 5, 10 (see FIG. 2). Each set of work rolls is placed into contact with the metal strip by driving one set of work rolls toward the other so that a leveling (flattening) force is impressed upon the metal strip as it passes therebetween. More specifically, contact between the work rolls and the metal strip material causes the metal strip to be repeatedly bent up and down (i.e., to S-wrap through the work rolls) as it passes through the work rolls, which repeated bending of the metal strip material removes stresses induced therein by the hot rolling process. Such a shape-correction leveler may be used to impart flatness across the entire width of a metal strip.

A shape-correction leveler may also be operated to selectively apply forces of different magnitudes to different areas of a strip of material passing therethrough. This selective application of force allows particular zones of the strip of material (from edge to edge) to be worked more than other zones as the strip passes through the leveler. Thus, shorter zones of the strip may be selectively elongated to match the length of the longer zones. This allows a shape-correction leveler to correct a variety of different shape defects. A typical shape-correction leveler setup 15 for correcting center buckle is shown in FIG. 3A, while a typical setup 20 for correcting edge wave is shown in FIG. 3B.

Each work roll of a typical shape-correction leveler is normal driven to propel the strip of material through the leveler during a leveling (flattening) operation. A shape-correction leveler drive system commonly consists of a main motor, a reduction gearbox, and a pinion gearbox, that cooperate to provide output rotation to each work roll.

An interesting phenomenon occurs when the work rolls of a shape-correction leveler penetrate into a strip of material being processed and the material S-wraps through the work rolls. With light penetration (e.g., at the exit end of the leveler) the roll surface speed substantially matches the strip speed. However, when the rolls penetrate deeper (e.g., at the entry end of the leveler), the roll surface speed tends to run slower than the strip speed. This phenomenon occurs because the material has a bend radius, (entry end of leveler) the surface speed of the material on the inside of the bend radius is moving slower than the surface speed on the outside of the bend radius (see FIG. 4). For purposes of illustration, one helpful analogy would be wheel speed on an automobile, wherein the wheels on both sides of the automobile rotate at the same RPM when the automobile is going straight, but the wheels on the inside of the curve will rotate slower than the wheels on the outside of the curve when the automobile is making a turn. In the case of a shape-correction leveler, the work rolls are contacting the inside radius of the bending strip material, so the rolls on the entry end of the leveler want to run slower to match this slower inside radius surface speed. One example of differential roll speed from an entry to an exit end of an exemplary leveler is depicted in FIG. 5.

This phenomenon may be referred to as differential roll speed (DRS). When the leveler work rolls are all driven together at the same speed (see e.g., FIG. 4 and FIG. 6), the entry rolls try to push the strip material through the exit rolls, while the exit rolls try to hold the material back. This DRS causes several issues in the leveler. One issue is that when the work rolls are geared together, the DRS causes high loading on the entry work rolls and internal torque windup within the roll drive system—which may cause premature failure of the drive components. Another issue is that more power consumed tends to be consumed when the work rolls are fighting each other. Yet another issue is that DRS tends to cause a compression of the strip material in a leveler rather than a stretching of the material, which reduces the effectiveness of the leveler.

SUMMARY

Exemplary shape-correction leveler drive system embodiments shown and described herein provide solutions to the above-described problem of differential roll speed.

One such exemplary leveler drive system embodiment employs a single drive motor in combination with a clutch that is associated with the entry-side rolls of a leveler.

Another such exemplary leveler drive system embodiment is a 4-Quad differential drive with clutch system, which employs a single drive motor in combination with a drive belt and a variable controlled clutch that is associated with the exit-side rolls of a leveler.

Another such exemplary leveler drive system embodiment is a 4-Quad differential drive with brake system, which employs a single drive motor in combination with a torque-controlling drag brake.

Yet another such exemplary leveler drive system embodiment employs a single drive motor in combination with a V-belt and pulley drive system.

Other aspects and features of the exemplary embodiments will become apparent to those skilled in the art upon review of the following detailed description of exemplary embodiments along with the accompanying drawing figures.

BRIEF DESCRIPTION OF THE DRAWINGS

In the following descriptions of the drawings and exemplary embodiments, like reference numerals across the several views refer to identical or equivalent features, and.

DETAILED DESCRIPTION OF THE EXEMPLARY EMBODIMENTS

Figures 1A, 1B, 1C, 1D:
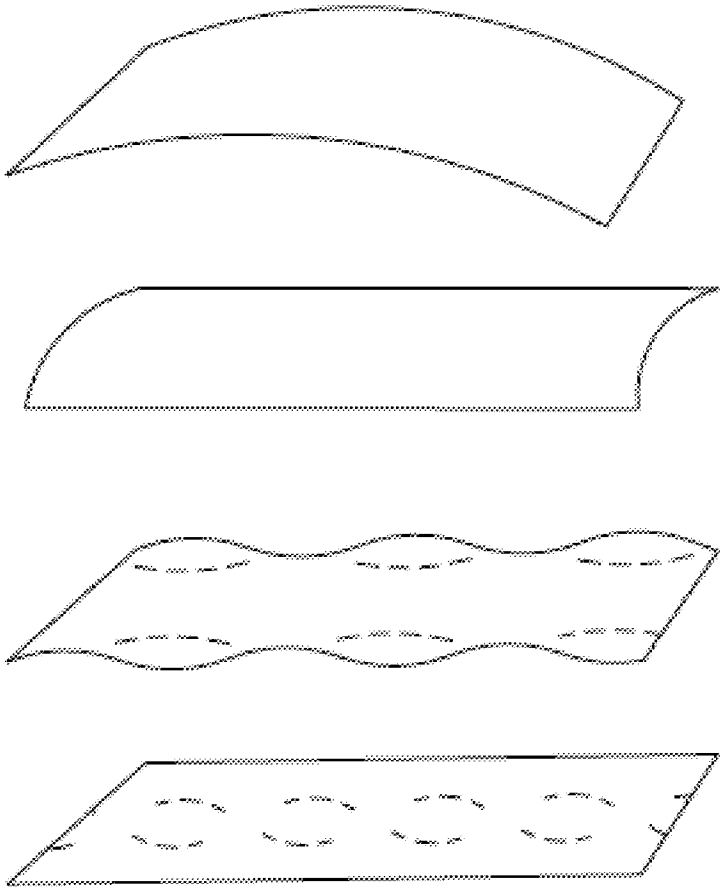
FIGS. 1A-1D illustrate several shape defects common to hot-rolled metal strip material.
Figure 2:
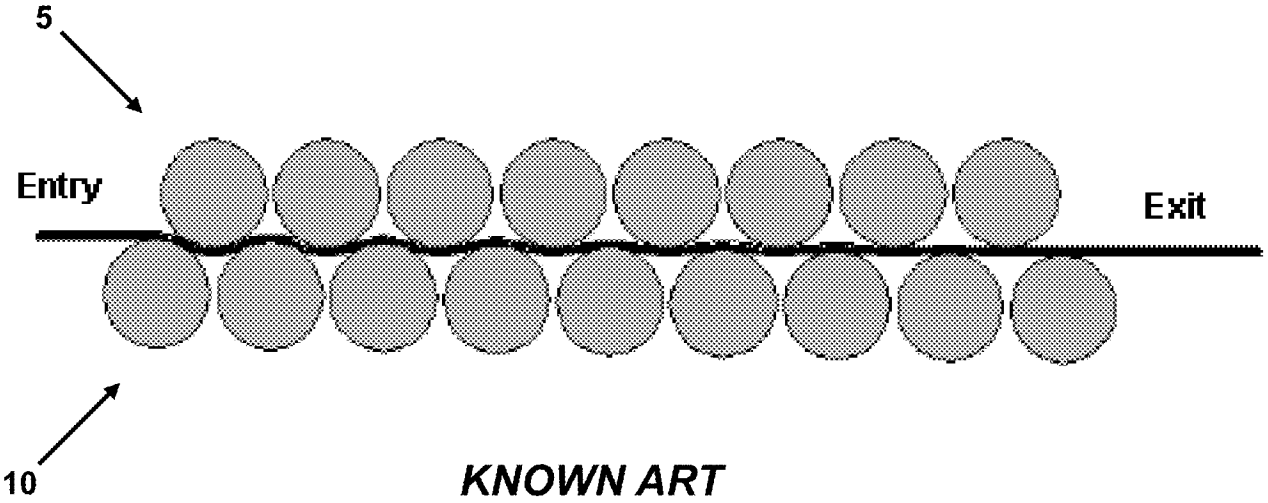
FIG. 2 depicts an exemplary upper and lower set of work rolls of a common shape-correction leveler.
Figure 3A:
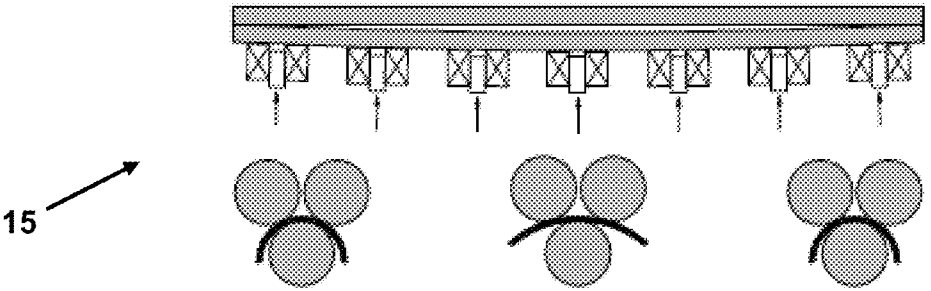
FIG. 3A depicts an exemplary technique for correcting a center buckle shape defect using a shape-correction leveler.
Figure 3B:
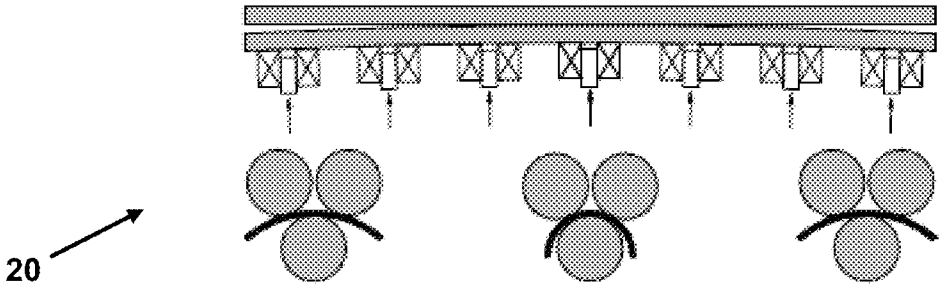
FIG. 3B depicts an exemplary technique for correcting an edge wave shape defect using a shape-correction leveler.
Figure 4:
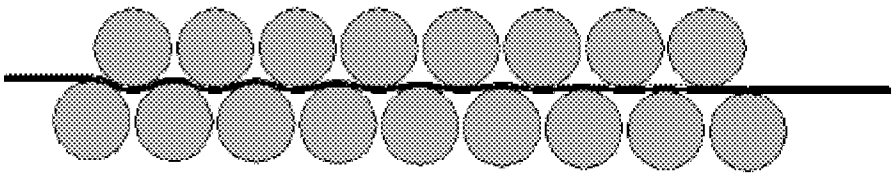
FIG. 4 and FIG. 5, in combination, illustrate the problem of differential roll speed on a multi-roll shape-correction leveler.
Figure 5:
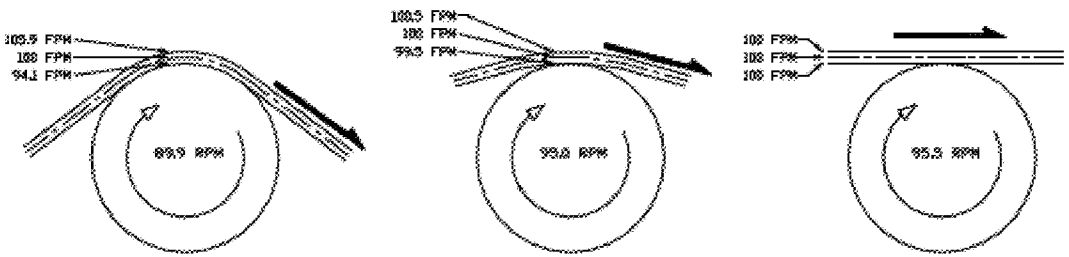
Figure 6:
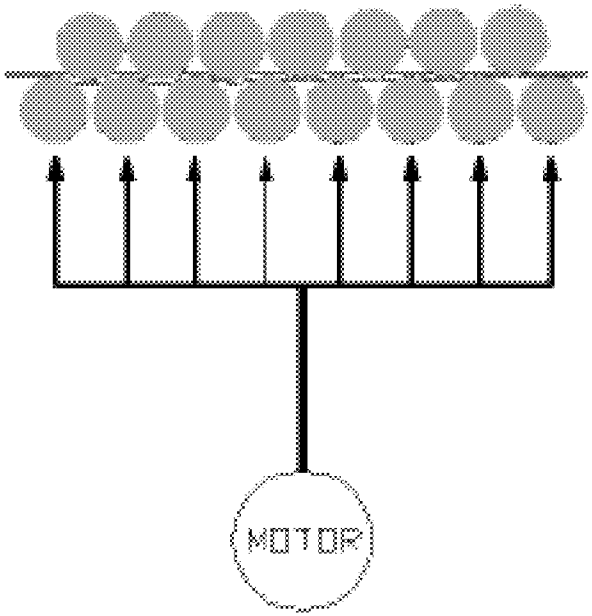
FIG. 6 represents a common shape-correction leveler drive scheme where all of the leveler work rolls are driven at the same speed.

FIGS. 4-6 illustrate, in combination, the aforementioned problem of differential roll speed (DRS) on a multi-roll leveler. That is, when the rolls of a multi-roll shape-correction leveler are all driven together at the same speed (see FIG. 6), the entry rolls try to push the strip material being leveled through the exit rolls, while the exit rolls are resisting such movement.

One solution to overcoming the DRS problem is to associate each of the upper and lower work roll drives with separate sets of work roll clusters (entry and exit). In such a design, the two gear clusters of each drive may still be in the same pinion gearbox housing with two inputs. By controlling the torque input to either the entry or exit roll drive cluster input, the loading on the drive system can be distributed substantially equally from entry side input to exit side input. As a result, both the entry side work rolls and the exit side work rolls will drive the strip of material being leveled in the forward direction, as opposed to the exit side rolls resisting torque.

Distributing the load in the aforementioned manner so that both the entry roll cluster and exit roll cluster drive inputs are driving in the forward direction also eliminates internal windup between the entry and exit cluster inputs, and greatly reduces the stress on the drive components. Also, since both the entry and exit roll clusters are both contributing torque in the forward direction, the strip material located between the work roll clusters will actually be in tension rather than compression, which will improve the leveling process.

Figure 7B:
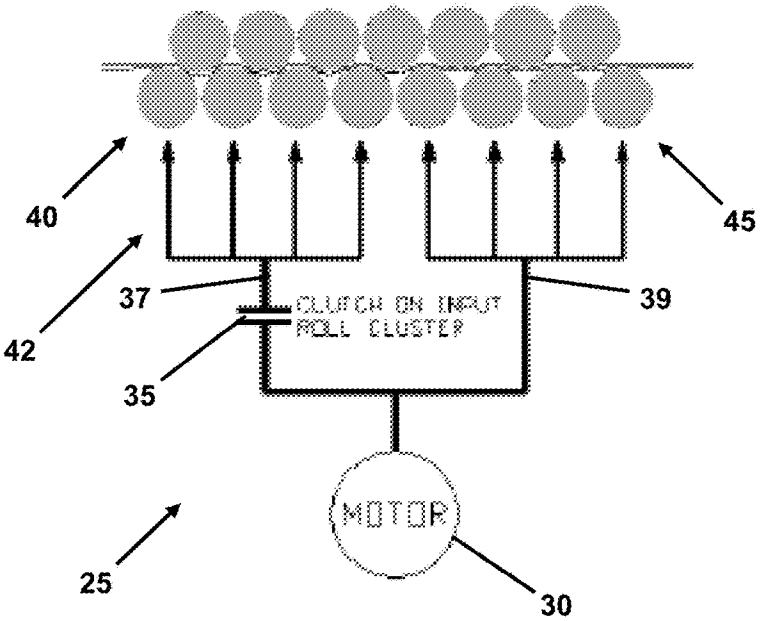
FIGS. 7A-7B illustrate one exemplary leveler drive system embodiment in the form of a drive motor with an entry-side clutch.
Figure 7A:
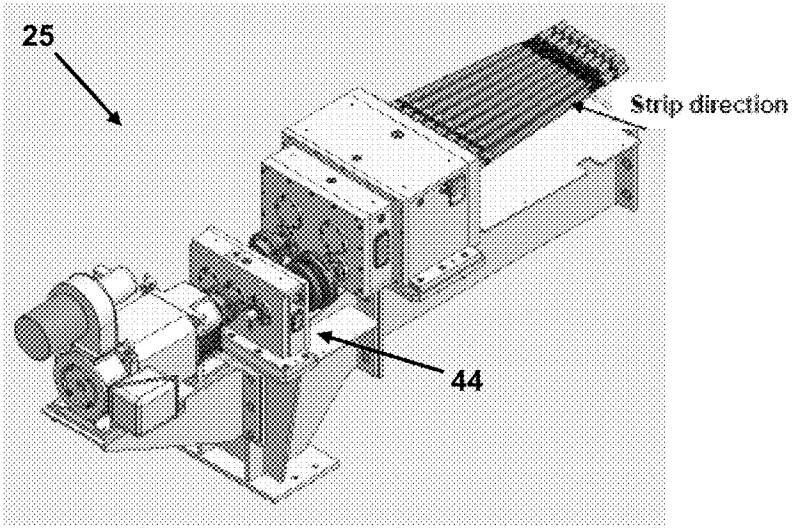

FIGS. 7A-7B depict one exemplary leveler drive system embodiment 25 for eliminating DRS issues. This particular embodiment is in the form of a 4-Quad differential drive with clutch system, which employs a single drive motor 30 in association with an entry-side clutch 35 for driving an exit work roll cluster 45 and an entry work roll cluster 40. More particularly, the output of the drive motor 30 is mechanically split (such as by a gearbox) to both an entry roll cluster input shaft 37 and an exit work roll cluster input shaft 39 of a pinion gear box 42.

In this exemplary embodiment, the clutch is a variable (slip) clutch 35 and is associated with the leveler entry roll cluster pinion box input shaft 37. One type of variable clutch that may be used in such an exemplary embodiment is an air-actuated slip clutch, where the slip torque of the clutch is proportional to the applied air pressure. Since the entire clutch assembly would actually rotate with the work roll cluster drive input shaft 37 in such an embodiment, the torque control air pressure may be applied through a rotary union on the end of the input shaft so the stationary air supply is routed to the rotating clutch. Other types of variable clutches may be utilized in other exemplary system embodiments.

While a variable clutch may be installed to the input shaft of either an entry work roll cluster 40 or exit work roll cluster 45 (see below), installing the clutch to the input shaft 37 of the entry work roll cluster 40 allows the gear-in speed from the roll drive to be the same for both work roll clusters (see FIG. 7B). The effect of differential roll speed due to a deeper plunge of the entry work rolls into the strip of material being leveled will cause the entry work roll cluster to rotate at a slower speed. Consequently, the clutch will drive and slip in the forward direction. It should be noted that while the exemplary embodiment of FIGS. 7A-7B is described herein only with respect to two work roll clusters (an entry cluster and an exit cluster), there could be three clusters (e.g., entry, center, exit) or more.

As described above, the drive torque input to each work roll cluster needs to be distributed from the main drive motor 30. This can be done, for example, via gearing 44 such as that shown in FIG. 7A. It is typically more difficult to achieve a small percentage lead speed with a geared distribution. Consequently, it is simpler to gear in both the entry side and exit side work roll clusters 40, 45 at the same speed, and to locate the clutch 35 on the entry side work roll cluster and rely on the DRS to provide the lower entry cluster speed.

With the clutch 35 installed to the entry work roll cluster 40, the exit roll drive controls the pace of the material strip being processed while the entry roll drive is trying to drive the strip faster due to DRS. By slipping instead of pushing strip material through the leveler, the variable clutch 35 is able to limit the torque to the entry work roll cluster 40, which prevents overload and torque windup. Because the entry work roll cluster 40 is now doing only half of the work, the exit work roll cluster 45 will do the remainder of the work and will pull on the strip material rather than resisting the torque applied by the entry roll cluster. By monitoring the drive motor total input torque and controlling the variable clutch torque, the load can be controlled to the entry cluster drive input so both cluster inputs will share the load equally.

The result of this exemplary drive arrangement is that the input torque is distributed equally to the two work roll clusters. Furthermore, because such a variable clutch slips at a low relative rotational speed, no problems with clutch life or heat buildup are expected.

Figure 8B:
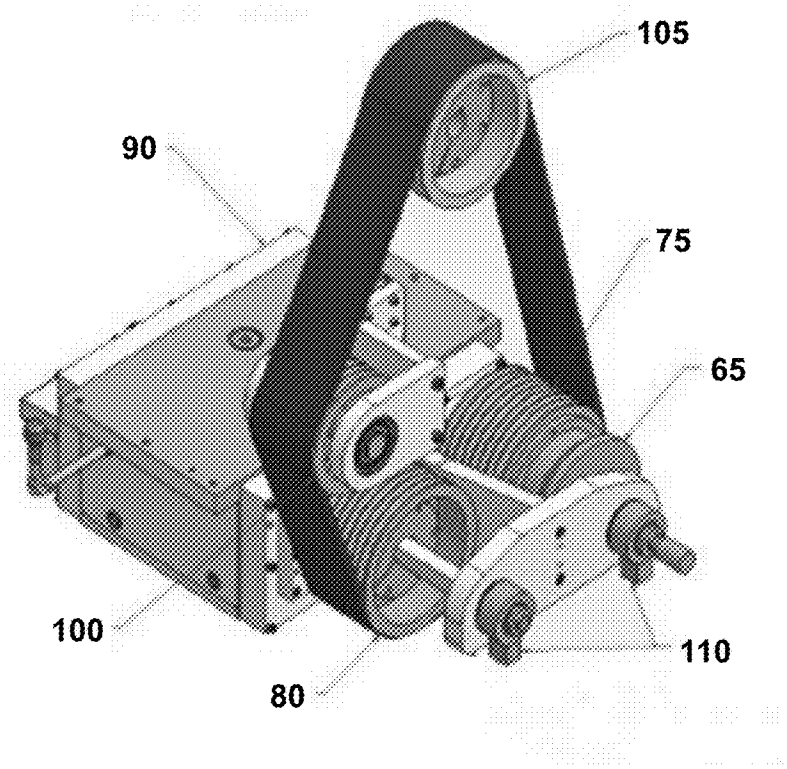
FIGS. 8A-8B illustrate another exemplary leveler drive system embodiment in the form of a 4-Quad differential drive with clutch system, which employs a drive motor in combination with a drive belt and a variable controlled clutch that is associated with the leveler exit rolls.
Figure 8A:
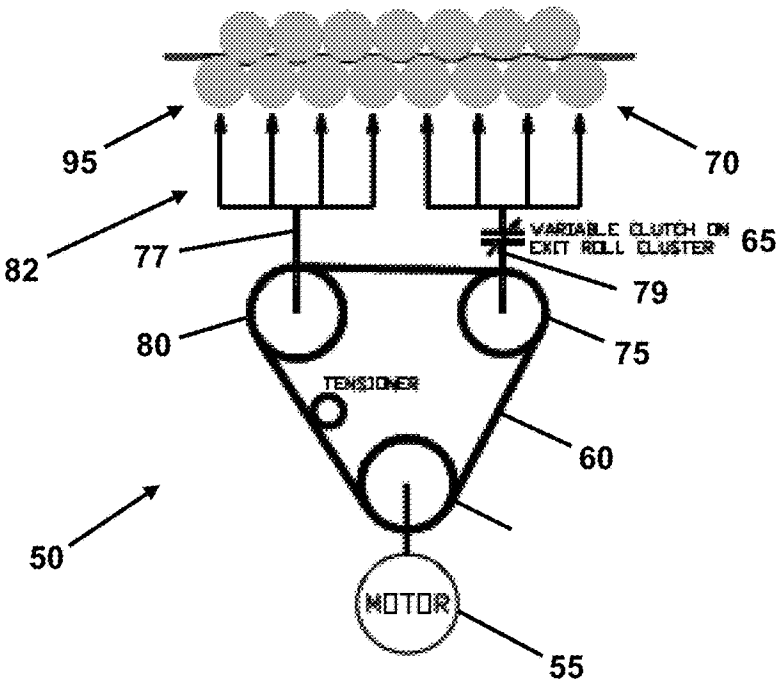

FIGS. 8A-8B depict another exemplary leveler drive system embodiment 50 for eliminating DRS issues. This particular embodiment is in the form of a 4-Quad differential drive with clutch system, which employs a single drive motor 55 that is coupled to a drive belt 60 via a motor drive pulley 105 for driving an exit work roll cluster 70 and an entry work roll cluster 95. More particularly, the output of the drive motor 55 is applied by the drive belt 60 to both an entry roll cluster input shaft 77 and an exit work roll cluster input shaft 79 of a pinion gear box 82 by way of an entry side input pulley 80 and an exit side input pulley 75.

The drive system 50 also includes a variably-controlled clutch 65 that is associated with the exit work roll cluster input shaft 79. One type of variable clutch that may be used in such an exemplary embodiment is an air-actuated slip clutch, where the slip torque of the clutch is proportional to the applied air pressure. Since the entire clutch assembly would actually rotate with the work roll cluster drive input shaft 79 in such an embodiment, the torque control air pressure may be applied through a rotary union on the end of the input shaft so the stationary air supply is routed to the rotating clutch. Other types of variable clutches may be utilized in other exemplary system embodiments. It should be noted that while the exemplary embodiment of FIGS. 8A-8B is described herein only with respect to two work roll clusters (an entry cluster and an exit cluster), there could be three clusters (e.g., entry, center, exit) or more.

When the clutch 65 is installed to the exit work roll cluster 70 as shown, the gear-in speed must be faster on the exit work roll cluster input to accommodate DRS and provide the lead speed needed for the clutch 65 to slip. The lead speed only needs to be very small, however, in the range of 2% for example. The belt drive of this exemplary drive system embodiment 50 provides a simple means by which to drive the exit work roll cluster 70 a small percentage faster.

In this embodiment, the drive belt 60 is used to drive two input pulleys 75, 80 of a dual pinion gearbox 90. One of the input pulleys 80 is associated with the entry roll cluster of the leveler. The exit pulley 75 of the dual pinion gearbox 90 is associated with the exit roll cluster 70 of the leveler. An idler pulley 100 may also be present, as may encoders 110. The encoders 110 may be used to monitor the actual rotational speed of the rolls of each cluster, which permits differential roll speed to be observed.

The exit-side pulley 75 of the dual pinion gearbox 90 has a diameter that is less than the diameter of the input-side pulley 80, so it will attempt to drive the rolls of the exit roll cluster 70 faster than the speed at which the rolls of the entry roll cluster 95 are rotated by the associated input pulley 80. The variably-controlled slip clutch 65 limits the torque transmitted to the exit roll cluster 70 by the output pulley 75, so as to prevent overload and to allow the exit rolls to operate at the correct speed. By monitoring the total input torque supplied by the motor 55 and controlling the variable clutch torque, the load to the exit roll cluster drive input can be controlled so that both the entry roll cluster 95 and the exit roll cluster 70 will equally share the load.

Exemplary leveler drive system embodiments for eliminating DRS that make use of a slip clutch, such as the exemplary embodiments of FIGS. 7A-7B and FIGS. 8A-8B, may be associated with various control schemes. Motor torque sensing may be a part of such a control scheme. More specifically, a means (e.g., sensor or sensors) may be provided for measuring the total torque load on the drive motor. As most modern AC vector drives include an output that is representative of true motor torque, such a motor may also be used in a slip-clutch based exemplary drive system embodiment. Otherwise, it is preferable to provide a sensor capable of determining the torque amps of the drive motor uses, as torque amps are at least somewhat linear with motor torque while actual amps (current draw) may not represent actual motor torque particularly well. It is also desirable to have a steady signal, so the control portion of an exemplary system may include a hardware or software filter to provide a smooth command signal to an associated electric regulator even when motor torque amps fluctuate.

By monitoring the torque amps of the main drive motor with a controller (e.g., a programmable controller) or similar device, the total process torque can be determined for any particular strip product being processed on the associated leveler. The programmable controller may then be used to adjust the air pressure supplied to the clutch, so that the slip torque is half the total applied torque, and the directly-driven work roll cluster will supply the remaining torque. The result of such a control scheme is that both entry and exit roll cluster inputs will share the load equally and operate at the correct speed, with both work roll clusters driving in the forward direction.

An electronic pressure regulator or similar air pressure control device may be employed to control the air pressure supplied to the clutch. Such a device may be operative, upon receipt of a signal from a connected controller, to accordingly regulate the output air pressure supplied to the clutch. The programmable controller processes the signals received from system sensors and provides a controlled output signal to the clutch. For example, a 0-10 volt DC output from a programmable logic controller (PLC) may produce a 0-60 PSI output from an electronic pressure regulator.

Figure 9:
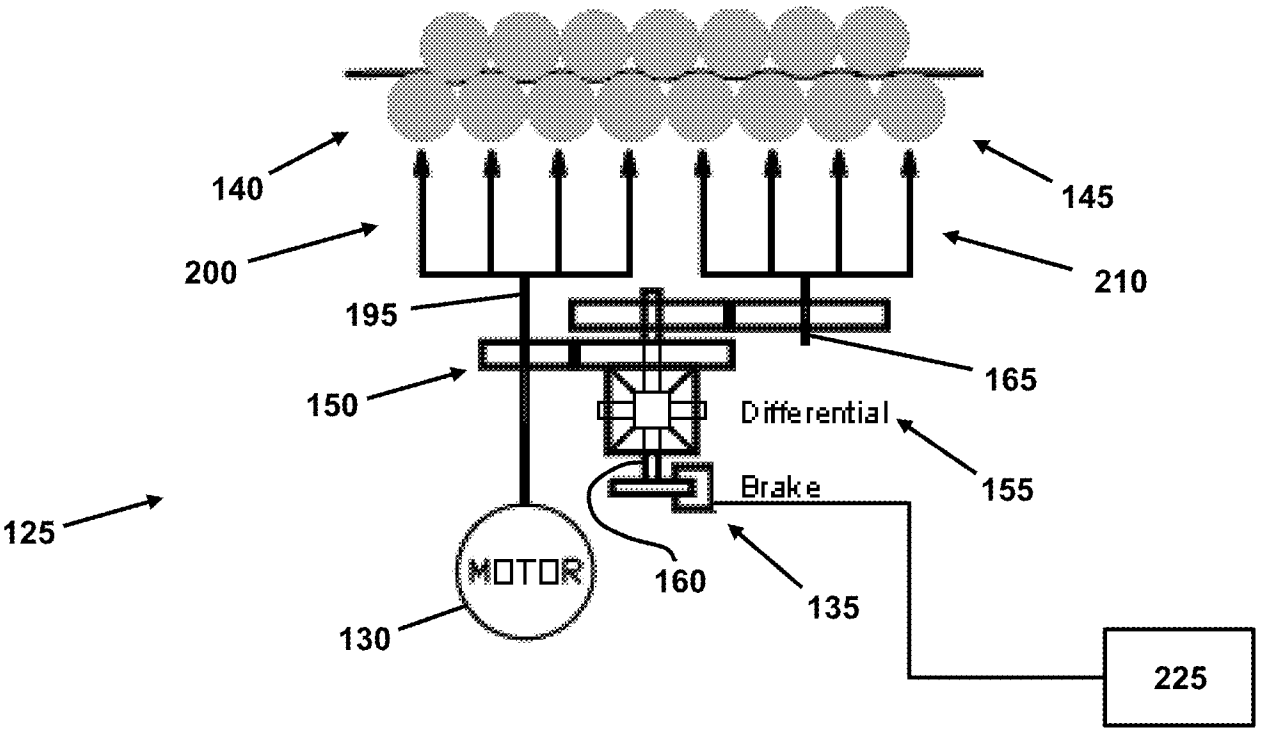
FIG. 9 illustrates another exemplary leveler drive system embodiment in the form of a 4-Quad differential drive with brake system, which employs a drive motor in combination with a torque-controlling drag brake.

FIG. 9 depicts another exemplary leveler drive system embodiment 125 for eliminating DRS issues. This particular embodiment is in the form of a 4-Quad differential drive with brake system, which employs a drive motor 130 in combination with a torque-controlling drag brake 135. In this exemplary embodiment, the entry roll cluster 140 of the leveler is directly-driven by one main drive motor 130, while the exit roll cluster 145 of the leveler is driven through gearing 150 from the main input shaft via a differential drive gear arrangement 155. The brake 135 may be associated with a microprocessor-based brake controller 225 that is programmed to provide precise torque control based on one or more monitored system conditions.

Mechanically speaking, the lead speed of the exit roll cluster 145 will attempt to run a small percentage faster than the entry cluster 140, but the speed is limited by a fixed ratio in the gearing. The drag brake 135 on the torque control shaft 160 of the differential 155 is used to control the amount of torque that is transmitted to the exit roll cluster 145. When the torque control input rotates, the exit roll cluster 145 will slow down. By monitoring the rotational speed of the torque control shaft 160 and controlling the brake torque, both the speed of the exit roll cluster drive input shaft 165 and the amount of torque applied thereto may be controlled.

Figure 10B:
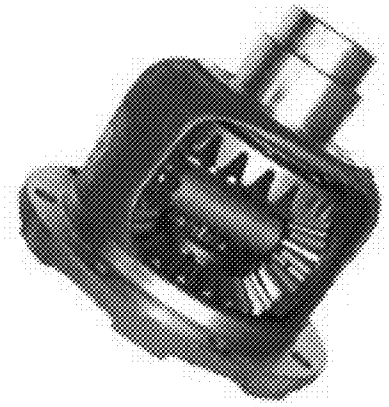
FIG. 10B depicts an exemplary differential hub wherein the cage and spider gears thereof are visible.
Figure 10A:
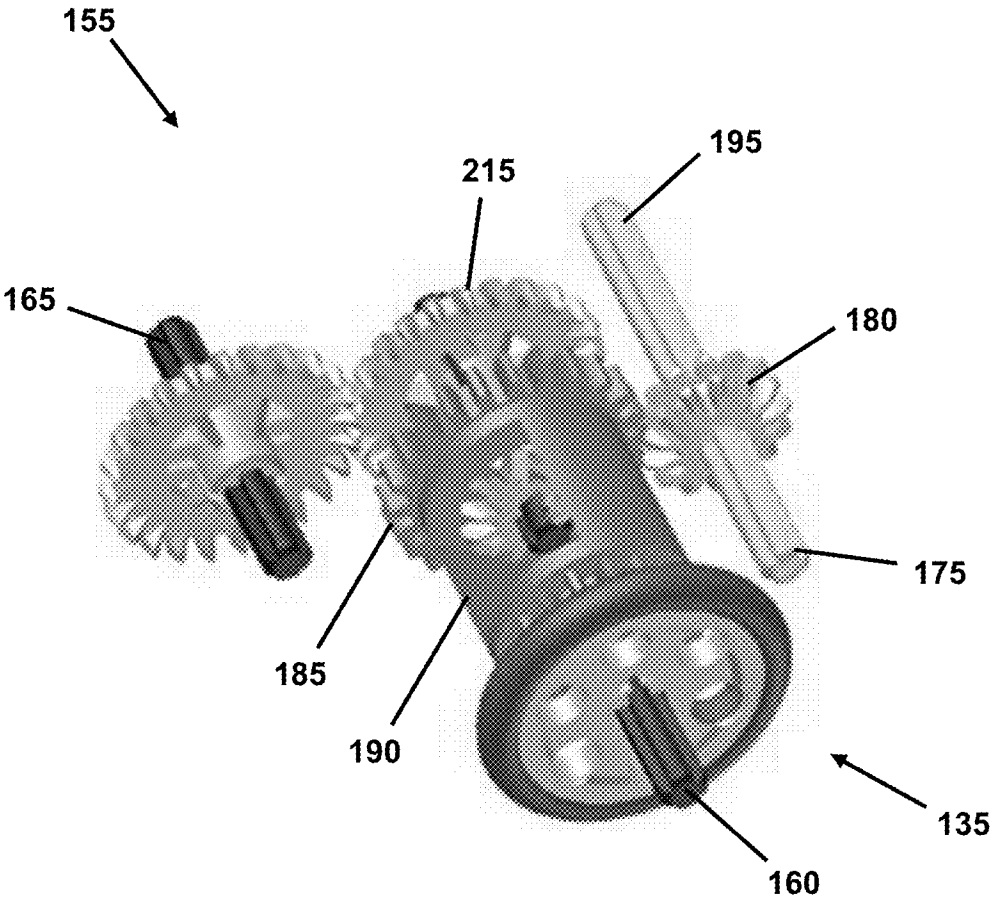
FIG. 10A depicts the various components of the differential drive of FIG. 9.

The individual components of the exemplary differential drive 155 of the 4-Quad differential drive with brake system 125 of FIG. 9 is schematically depicted in more detail in FIG. 10A. FIG. 10B shows an actual differential hub with a cage and spider gears.

Referring to FIG. 10A, it can be seen that the differential 155 includes a main drive motor input shaft 175. The main drive motor 130 is coupled to the main drive motor input shaft 175, which passes through a main drive motor input shaft pinion gear 180 that drives the differential hub via a differential hub mating gear 185 mounted on the differential hub cage 190. The main drive motor input shaft 175 terminates in an entry roll cluster drive input shaft 195 that drives the entry work roll cluster 140 via entry cluster gearing 200 in the pinion gear box 205 (see FIG. 9). Consequently, the entry roll cluster will always run at the same speed as the main drive motor 130.

The exit roll cluster drive input shaft 165, which drives the exit work roll cluster 145 via exit cluster gearing 210 in the pinion gear box 205, is driven by a pinion gear 215 of the differential hub that mates with a drive gear 220 attached to the exit roll cluster drive input shaft. The ratio of the gear set comprising the main drive motor input shaft pinion gear and the differential hub mating gear 180, 185 may be slightly less than 2:1 so that the differential hub cage 190 will rotate slightly faster than half of the input speed applied to the main drive motor input shaft 175. A characteristic of the differential hub is that it will amplify the rotational output speed to the pinion gear 215 driving the exit roll cluster drive input shaft 165 by a factor of two.

When the torque control shaft 160 is held stationary, the exit roll cluster drive input shaft 165 will rotate slightly faster than the entry roll cluster drive input shaft 195. The rotational speed percentage increase on the exit roll cluster drive input shaft 165 is approximately 2%-3% greater than the rotational speed of the entry roll cluster drive input shaft 195, as determined by the ratio of the gear set comprising the main drive motor input shaft pinion gear and the differential hub mating gear 180, 185. This lead speed increase on the exit roll cluster drive input shaft 165 compensates for DRS caused by plunging the work rolls into the strip of material being leveled, as described above. This lead speed increase on the exit roll cluster drive input shaft 165 also ensures that the work rolls of the exit roll cluster will apply tension to the strip of material being leveled after the strip of material leaves the entry roll cluster.

The amount of torque control applied to the torque control shaft 160 of the differential 155 is determined by the drag force of the brake 135 during slipping, and is selected such that the total input torque supplied to the main drive motor input shaft 175 is applied equally by the exit roll cluster drive input shaft 165 and the entry roll cluster drive input shaft 195. Therefore, at a full brake setting and with full torque applied to the main drive motor input shaft 175, the resultant output torque will be split equally between the exit roll cluster drive input shaft 165 and the entry roll cluster drive input shaft 195.

During operation, the torque control shaft 160 will slip very slowly, as determined by its input speed and the ratio of gear set comprising the main drive motor input shaft pinion gear and the differential hub mating gear 180,185, minus any differential rotational speed due to roll plunge. Therefore, by controlling the pressure applied to the brake 135, the output torque of the exit roll cluster drive input shaft 165 may be adjusted from zero to approximately one half of the input torque supplied to the main drive motor input shaft 175.

While only a brake is shown in this exemplary embodiment, torque control of the torque control shaft 160 may also be accomplished in other exemplary embodiments using a torque-controlled servo motor (not shown). Also, while an exemplary differential hub may employ bevel gears as shown in FIGS. 10A-10B, a differential hub that utilizes planetary gears may also be used.

The brake slip torque of an exemplary 4-Quad differential drive with brake system may be determined by several exemplary control schemes that are all simultaneously active. These exemplary control schemes may include, for example, maximum operating torque, roll slip control, and entry cluster reduced torque due to roll plunge.

According to a maximum operating torque control scheme, the actual torque load of the main drive motor may be monitored. The maximum slip torque of the brake may then be adjusted so that output torque on exit roll cluster drive input shaft will not exceed one half of the actual torque applied to the main drive motor input shaft. Such a control scheme will provide for equal load sharing between entry and exit roll clusters during normal leveler operation.

According to a roll slip control scheme, a pulse tachometer may be coupled to the torque control input shaft. A processor, such as the brake control processor, may then be used to monitor the rotational speed of the torque control shaft and the rotational speed of the main drive motor input shaft. The rotational speed of the exit rolls may be subsequently calculated, as well as the actual differential roll speed. The control scheme may then operate to maintain the rotational speed of the exit rolls within a speed range no less than the rotational speed of the entry rolls, and no more than the maximum differential roll speed that can be caused by work roll plunge.

The geared in lead speed may be set up to be more than the maximum possible differential roll speed, which speed is reached when the torque control shaft comes to a complete stop while the main drive motor input shaft continues to turn. Therefore, by monitoring the rotational speed of the torque control input shaft, it can be determined if the exit cluster rolls are slipping. If the exit cluster rolls are slipping faster than they should be, the brake torque can be reduced until the exit cluster rolls are within the correct rotational speed range. Such a system may have a principle of operation similar to that of a traction control system on modern automobiles.

Another function of an exemplary brake control processor may be to limit exit cluster roll torque based on exit roll position. In this regard, an exemplary system may monitor the actual roll plunge of the associated leveler. For low yield materials, it is common practice to set the gap between the upper and lower exit work rolls to a distance that is greater than the actual thickness of the strip material being leveled. With such a setup, however, it is possible to concentrate the input torque of the exit roll cluster to only the first few work rolls of the exit roll cluster, which could possibly overload the leveler drive components. When using an exemplary 4-Quad differential drive with brake system, the slip brake will operate at a lower torque to protect the exit roll drive components in such a situation.

Figure 11:
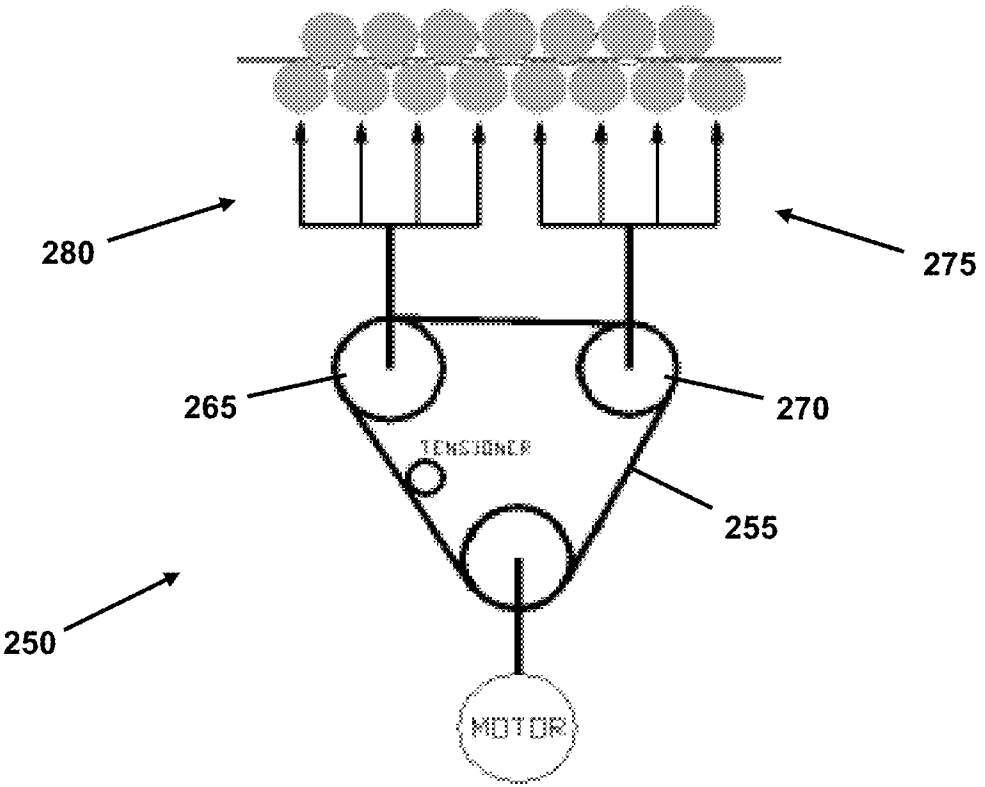
FIG. 11 illustrates an exemplary leveler drive system embodiment in the form of a V-belt and pulley drive.

FIG. 11 depicts yet another exemplary leveler drive system embodiment 250 for eliminating DRS issues. This particular embodiment is in the form of a V-belt and pulley drive system. In this exemplary embodiment, a multi-groove V-belt 255 is used to drive a dual input gearbox 260 via an entry-side pulley 265 and an exit-side pulley 270. The exit-side pulley 270 may have a diameter that is slightly smaller than the diameter of the entry-side pulley 265, such that the work rolls of a leveler exit work roll cluster 275 are driven slightly faster than the work rolls of an entry roll cluster 280 thereof to account for DRS. Tension of the V-belt 255 is controlled and may slip a small amount so as to also act as a torque limiter to internal torque wind up.

It should be understood that each of the exemplary embodiments shown and described herein only illustrate a drive system for one half of a leveler. More specifically, for purposes of clarity and simplicity, only the lower set of work rolls of a leveler are shown to be driven by the exemplary leveler drive system embodiments described herein. In practice, another exemplary leveler drive system embodiment would be provided to drive the upper set of leveler work rolls that can be seen in each of the drawing figures. Thus, in each case, there would be an upper work roll drive system and a lower work roll drive system, each having separate drive motors. A single controller may be provided to control both an upper work roll drive system and a lower work roll drive system or, alternatively, each of an upper work roll drive system and lower work roll drive system may have its own controller.

While certain exemplary embodiments are described in detail above, the scope of the invention is not considered limited by such disclosure, and modifications are possible without departing from the spirit of the invention.

What is claimed is:

1. A shape-correction leveler drive system, comprising:

a lower work roll drive system, the lower work roll drive system further comprising:

a lower work roll drive motor associated with a set of lower work rolls of a shape-correction leveler, the set of lower work rolls divided into an entry work roll cluster and an exit work roll cluster, distribution gearing interposed between the lower work roll drive motor and the set of lower work rolls, the distribution gearing having an entry side output shaft and an exit side output shaft, a pinion gear box interposed between the distribution gearing and the set of lower work rolls, the pinion gearbox adapted to engage the output shafts of the distribution gearing and to drive the entry work roll cluster separately from the exit work roll cluster, and a variable clutch associated with the entry side work roll cluster;

an upper work roll drive system, the upper work roll drive system further comprising:

an upper work roll drive motor associated with a set of upper work rolls of the shape-correction leveler, the set of upper work rolls divided into an entry work roll cluster and an exit work roll cluster, distribution gearing interposed between the upper work roll drive motor and the set of upper work rolls, the distribution gearing having an entry side output shaft and an exit side output shaft, a pinion gear box interposed between the distribution gearing and the set of upper work rolls, the pinion gearbox adapted to engage the output shafts of the distribution gearing and drive the entry work roll cluster separately from the exit work roll cluster, and a variable clutch associated with the entry side work roll cluster; and a controller in communication with the variable clutch associated with each of the lower work roll drive system and the upper work roll drive system, the controller programmed to monitor an amount of total input torque provided by each of the respective drive motors and to adjust an amount of slippage of the associated variable clutches, so as to control a torque load applied to the entry work roll cluster of each set of lower and upper work rolls of the shape-correction leveler and thereby produce an equal sharing of load between the entry work roll cluster and exit work roll cluster of each set of lower and upper work rolls.

2. The leveler drive system of claim 1, wherein each variable clutch is an air-actuated slip clutch whose slip torque is proportional to an air pressure applied thereto.

3. The leveler drive system of claim 2, further comprising an electronic air regulator in communication with the controller and adapted to regulate the air pressure to the air-actuated slip clutches in response to signals from the controller.

4. The leveler drive system of claim 2, wherein air is supplied to the air-actuated slip clutches through corresponding rotary unions.

5. The leveler drive system of claim 1, wherein the gear-in speed of the entry work roll cluster and exit work roll cluster of the lower set of work rolls is the same, and the gear-in speed of the entry work roll cluster and exit work roll cluster of the upper set of work rolls is the same.

6. The leveler drive system of claim 1, wherein the variable clutches are respectively installed to entry work roll cluster input shafts of the lower and upper work roll drive system pinion gear boxes.

7. The leveler drive system of claim 1, further comprising sensors for measuring the total torque load on the lower work roll drive motor and the upper work roll drive motor.

8. The leveler drive system of claim 7, wherein the sensors measure the torque amps of the motors.

9. The leveler drive system of claim 1, wherein the drive motors are AC vector drive motors capable of outputting a signal that is representative of true motor torque.

10. A shape-correction leveler drive system, comprising:

a lower work roll drive system, the lower work roll drive system further comprising:

a lower work roll drive motor associated with a set of lower work rolls of a shape-correction leveler, the set of lower work rolls divided into an entry work roll cluster and an exit work roll cluster, a drive pulley coupled to the lower work roll drive motor;

an entry-side input pulley having an entry side output shaft and an exit-side input pulley having an exit side output shaft, the input pulleys rotatably coupled to the drive pulley by a drive belt, a pinion gear box interposed between the input pulleys and the set of lower work rolls, the pinion gearbox adapted to engage the output shafts of the input pulleys and to drive the entry work roll cluster separately from the exit work roll cluster, and a variable clutch associated with the exit side work roll cluster;

an upper work roll drive system, the upper work roll drive system further comprising:

an upper work roll drive motor associated with a set of upper work rolls of the shape-correction leveler, the set of upper work rolls divided into an entry work roll cluster and an exit work roll cluster, a drive pulley coupled to the upper work roll drive motor;

an entry-side input pulley having an entry side output shaft and an exit-side input pulley having an exit side output shaft, the input pulleys rotatably coupled to the drive pulley by a drive belt, a pinion gear box interposed between the input pulleys and the set of upper work rolls, the pinion gearbox adapted to engage the output shafts of the input pulleys and to drive the entry work roll cluster separately from the exit work roll cluster, and a variable clutch associated with the exit side work roll cluster; and a controller in communication with the variable clutch associated with each of the lower work roll drive system and the upper work roll drive system, the controller programmed to monitor an amount of total input torque provided by each of the respective drive motors and to adjust an amount of slippage of the associated variable clutches, so as to control a torque load applied to the exit work roll cluster of each set of lower and upper work rolls of the shape-correction leveler and thereby produce an equal sharing of load between the entry work roll cluster and exit work roll cluster of each set of lower and upper work rolls.

11. The leveler drive system of claim 10, wherein each variable clutch is an air-actuated slip clutch whose slip torque is proportional to an air pressure applied thereto.

12. The leveler drive system of claim 11, further comprising an electronic air regulator in communication with the controller and adapted to regulate the air pressure to the air-actuated slip clutches in response to signals from the controller.

13. The leveler drive system of claim 10, wherein the variable clutches are respectively installed to exit work roll cluster input shafts of the lower and upper work roll drive system pinion gear boxes.

14. The leveler drive system of claim 10, wherein the gear-in speed of the exit work roll cluster of the lower set of work rolls is faster than that of the entry work roll cluster of the lower set of work rolls, and the gear-in speed of the exit work roll cluster of the upper set of work rolls is faster than that of the entry work roll cluster of the upper set of work rolls.

15. The leveler drive system of claim 14, wherein a diameter of each exit-side pulley is less than a diameter of each input-side pulley such that a rotational speed of the exit work roll clusters is caused to be faster than the rotational speed of the entry work roll clusters.

16. The leveler drive system of claim 10, further comprising sensors for measuring the total torque load on each of the lower work roll drive motor and the upper work roll drive motor.

17. The leveler drive system of claim 16, wherein the sensors measure the torque amps of the motors.

18. The leveler drive system of claim 10, wherein the drive motors are AC vector drive motors capable of outputting a signal that is representative of true motor torque.

19. A shape-correction leveler drive system, comprising:

a lower work roll drive system, the lower work roll drive system further comprising:

a lower work roll drive motor associated with a set of lower work rolls of a shape-correction leveler, the set of lower work rolls divided into an entry work roll cluster and an exit work roll cluster, a means of distributing the torque output of the lower work roll drive motor to separate entry side and exit side output shafts, a pinion gear box adapted to engage the output shafts and to drive the entry work roll cluster separately from the exit work roll cluster, and a variable clutch installed on one of an entry side or exit side input shaft of the pinion gearbox;

an upper work roll drive system, the upper work roll drive system further comprising:

an upper work roll drive motor associated with a set of upper work rolls of the leveler, a means of distributing the torque output of the upper work roll drive motor to separate entry side and exit side output shafts, a pinion gear box adapted to engage the output shafts and to drive the entry work roll cluster separately from the exit work roll cluster, and a variable clutch installed on one of an entry side or exit side input shaft of the pinion gearbox; and a controller in communication with the variable clutch associated with each of the lower work roll drive system and the upper work roll drive system, the controller programmed to monitor an amount of total input torque provided by each of the respective drive motors and to adjust an amount of slippage of the associated variable clutches, so as to control a torque load applied to either the entry or exit work roll clusters of the sets of lower and upper work rolls and thereby produce an equal sharing of load between the entry work roll cluster and exit work roll cluster of each set of lower and upper work rolls.

20. The leveler drive system of claim 19, wherein each variable clutch is an air-actuated slip clutch whose slip torque is proportional to an air pressure applied thereto, and further comprising an electronic air regulator in communication with the controller and adapted to regulate the air pressure to the air-actuated slip clutches in response to signals from the controller.

* * * * *